US008640292B1

(12) United States Patent
Sorkin

(10) Patent No.: US 8,640,292 B1
(45) Date of Patent: Feb. 4, 2014

(54) DEVIATOR SYSTEM FOR USE IN POST-TENSION SEGMENTAL CONCRETE CONSTRUCTION

(76) Inventor: Felix L. Sorkin, Stafford, TX (US)

( * ) Notice: Subject to any disclaimer, the term of this patent is extended or adjusted under 35 U.S.C. 154(b) by 0 days.

(21) Appl. No.: 13/476,495

(22) Filed: May 21, 2012

(51) Int. Cl.
*E01D 11/02* (2006.01)

(52) U.S. Cl.
USPC ..... 14/18; 14/22

(58) Field of Classification Search
USPC ..... 14/18, 19, 20, 21, 22; 52/80.1, 81.6, 85
See application file for complete search history.

(56) References Cited

U.S. PATENT DOCUMENTS

| | | | | |
|---|---|---|---|---|
| 63,901 | A * | 4/1867 | James | 14/18 |
| 4,505,081 | A * | 3/1985 | Dinis et al. | 52/223.14 |
| 4,799,279 | A * | 1/1989 | Muller | 14/77.1 |
| 5,121,518 | A * | 6/1992 | Muller | 14/21 |
| 5,231,931 | A | 8/1993 | Sauvagiot | |
| 5,762,300 | A | 6/1998 | Sorkin | |
| D400,670 | S | 11/1998 | Sorkin | |
| 6,666,233 | B1 | 12/2003 | Sorkin | |
| D492,987 | S | 7/2004 | Sorkin | |
| D492,988 | S | 7/2004 | Sorkin | |
| 7,200,886 | B2 * | 4/2007 | Nuetzel et al. | 14/22 |
| 7,299,516 | B2 * | 11/2007 | Nuetzel et al. | 14/22 |
| 7,943,217 | B2 * | 5/2011 | Baumgartner | 428/34.5 |

* cited by examiner

*Primary Examiner* — Gary Hartmann
(74) *Attorney, Agent, or Firm* — Egbert Law Offices, PLLC

(57) ABSTRACT

A deviator apparatus for use in segmental concrete construction has a duct and a pipe extending through an interior of the duct. The duct has a first end and a second end and a central portion. The first end has a diameter substantially greater than a diameter of the central portion. The pipe has a diameter substantially less than a diameter of a duct at the first end. The pipe has a length substantially greater than a length of the duct. A plurality of tendons extend through the pipe. The duct increases constantly in diameter from the central portion to the first end. The duct has ribs formed on an exterior surface thereof.

7 Claims, 5 Drawing Sheets

DEVIATOR SYSTEM FOR USE IN POST-TENSION SEGMENTAL CONCRETE CONSTRUCTION

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to post tension segmental construction. More particularly, the present invention the relates to deviators as used with external tensioning in segments in such segmental construction.

2. Description of Related Art Including Information Disclosed Under 37 CFR 1.97 and 37 CFR 1.98.

Precast segmental bridges are known and commonly used throughout the world as a means to forge roadways through mountainous terrain or across rivers or other barriers. Such bridges are typically constructed in accordance with the following sequence: First, a series of upright piers are formed along the bridge span. Thereafter, cantilevered bridge sections are built out of each pier by successively mounting the precast segments to previously completed bridge components and post-tensioning the segments thereto. The cantilevered bridge sections are built out from each pier in a symmetrical fashion so that the piers are not subjected to undue bending loads. When the cantilevered sections are complete, the ends thereof are post-tensioned together to form a continuous bridge deck. Typically, two such bridge spans are constructed to accommodate the two directions of travel. These spans are generally side-by-side, but need not be parallel (horizontally or vertically) nor at the same elevation.

FIGS. 1-4 illustrate a form of such precast segmental bridge construction in accordance with the teachings of U.S. Pat. No. 5,231,931, issued on Aug. 3, 1993 to G. Sauvagiot. This form of segmental precast bridge construction is particularly disclosed as used with a rapid transit viaduct system.

Referring to FIG. 1, there is shown an end view of a rapid transit viaduct section 2 with rapid transit vehicles 32 and 34 thereon. The section 2 includes a concrete segment 3. The section 2 has a central load-bearing member, or body member 4, supported by a pair of upright pier members 6 and 8. Extending laterally from opposite lower side portions of the body member 4 are a pair of lateral platform structures 10 and 12. Each of the platform structures 10 and 12 has a pair of rails 14 mounted thereon for carrying a rapid transit vehicle 32 and 34. In addition, each of the platform structures 10 and 12 can have an upright sidewall section 16 as required for safety, noise pollution, and other considerations. One or more sets of rails 14 are carried by each of the lateral platform structures depending on the requirements of the transit systems.

The platform structures 10 and 12 each include respective upper platform decks and respective lower support struts 22 and 24. The lower support struts 22 and 24 are mounted as close to the bottom of the body member 4 as practicable. Deck members 18 and 20 are mounted to the body member 4 at an intermediate portion thereof above the support struts 22 and 24. The support struts 22 and 24 angle upwardly from their point of attachment with the body member 4 until they intersect the deck members 18 and 20. As such, the deck members 18 and 20 and support struts 22 and 24 form a box section providing resistance to torsional loading caused by track curvature and differential train loading. This box section may be considered a closed base. The body member 4 bisects the closed base and extends vertically upwardly therefrom to provide span-wise bending resistance. Preferably, the entire duct section 2 is cast as a single reinforced concrete cross-section.

The platform structures 10 and 12 each include lower pier mounts 26 and 28. These are mounted respectively to the bottom of the support structures 22 and 24. The pier mounts 26 and 28 are, in turn, supported, respectively, on the piers 6 and 8 using a plurality of neoprene pads 30, which provide a cushioned support for the structure.

The viaduct section 2 shown in FIG. 1 forms part of a viaduct system supporting rails 14 for carrying rapid transit vehicles 32 and 34. The viaduct section 2 may be formed as a precast modular segment 3. The viaduct section 2 is then combined with other viaduct sections to form a precast segmental structure. To facilitate such construction, the body member 4 may be formed with interlock member 36, while the lateral platform structures 10 and 12 may be each formed with interlock members 38.

Referring to FIG. 2, there is shown a plan view of a viaduct system formed from precast sections 2. The sections 2 are modular concrete segments that are combined to form a precast segmental structure extending between sequentially positioned piers (not shown). The sections 2 are placed in longitudinally-abutting relationship. To facilitate that construction, the sections are match cast so that the abutting end portions thereof fit one another in an intimate interlocking relationship. Each successive section is therefor cast against a previously cast adjacent section to assure interface continuity.

The connection between adjacent modular sections 2 is further secured by way of the interlock members 36 and 38. On one end of each section 2, the interlock members 36 and 38 are formed as external key members. On the opposite end of each section 2, the interlock members are formed as an internal slot or notch, corresponding to the key members of the adjacent viaduct system. Matchcasting assures that corresponding key members and slots, as well as the remaining interface surfaces, properly fit one another.

As seen in FIG. 2, the sections 2 are bound together with one or more post-tensioning cables or tendons 40, 42 and 44. The number of cables used will depend on a number of factors such as cable thickness, span length, and loading requirements. The tensioning cables are each routed along a predetermined path which varies in vertical or lateral position along the span of the segmental structure. The tensioning cables are used for lateral tensioning and the external tensioning at the segments.

Referring to FIG. 3, there is shown an end view of a concrete segment 3 used in segmental construction of a rapid transit system. Adjacent segments are held together by post-tensioning cables 42 and 44 that extend through the concrete segment 3. As can be seen in FIG. 3, post-tensioning cables 40 are positioned externally of the concrete segment 3, and internal post-tensioning cables 42 and 44 are positioned internally of the concrete segment 3. Cables 42 and 44 extend through tunnels 50 formed in the concrete segment 3. It is important to note that multiple post-tension cables 42 can extend through a single tunnel 50 formed within the concrete segment 3. Cables 45 are shown as extending through the box 47 of the segment 3. Cables 45 are utilized for the external tensioning of the concrete segments. Experiments have shown that 50% internal tensioning and 50% external tensioning is optimal for such construction.

In such post-tension segmental construction, piers occur periodically along the length of the structure. When these piers occur, it is necessary to use a generally solid concrete segment at the segment on top of the pier. Additionally, it is necessary to route the post-tension tendon in a proper direction through such a solid concrete segment. Typically, this will require that the tendons will have a bend extending through this segment and a bend extending outwardly of the segment. Typically, when the cables have a bend, they will bear very strongly against the ends of the duct through which they pass. This can establish an undesirable point-of-contact force. Ultimately, the forces that occur because of this abrupt point-of-contact could potentially damage the post-tension tendon after the tensioning has occurred or would damage the integrity of the duct through which such tendons pass. As such, a need has developed so as to provide a duct which minimizes the effect of the point-of-contact of the bend of the post-tension tendons with the surfaces of the duct. Additionally, there is a need to enhance the ability to properly route the post-tension tendons through the duct.

Various patents have issued, in the past, for devices relating to such multi-strand duct assemblies. For example, U.S. Design Pat. No. 400,670, issued on Nov. 3, 1998, to the present inventor, shows a design of a duct. This duct design includes a tubular body with a plurality of corrugations extending outwardly therefrom. This tubular duct is presently manufactured and sold by General Technologies, Inc. of Stafford, Tex., the licensee of the present inventor.

U.S. Pat. No. 5,762,300, issued on Jun. 9, 1998, to the present inventor, describes a tendon-receiving duct support apparatus. This duct support apparatus is used for supporting a tendon-receiving duct. This support apparatus includes a cradle for receiving an exterior surface of a duct therein and a clamp connected to the cradle and extending therebelow for attachment to an underlying object. The cradle is a generally U-shaped member having a length greater than a width of the underlying object received by the clamp. The cradle and the clamp are integrally formed together of a polymeric material. The underlying object to which the clamp is connected is a chair or a rebar.

U.S. Pat. No. 6,666,233, issued on Dec. 23, 2003 to the present inventor, shows another form of a tendon-receiving duct. In this duct, each of the corrugations is in spaced relationship to an adjacent corrugation. The tubular body has an interior passageway suitable for receiving cables therein. Each of the corrugations opens to the interior passageway. The tubular body has a first longitudinal channel extending between adjacent pairs of the corrugations on the top side of the tubular body. The tubular body has a pair of longitudinal channels extending between adjacent pairs of the corrugations on a bottom side of the tubular body.

U.S. Design Pat. No. D492,987, issued on Jul. 13, 2004, to the present inventor, illustrates a design of a three-channel duct having a plurality of generally trapezoidal-shaped ribs with a first channel extending across a top of the tubular body and a pair of channels extending across the bottom of the tubular body.

U.S. Design Pat. No. D492,988, issued on Jul. 13, 2004 to the present inventor, discloses a monostrand duct for receiving a single tendon therein. This monostrand duct has a plurality of ribs formed along the exterior of the body. Each of the ribs has a generally box-like cross-section. A pair of diametrically-opposed longitudinal channels extend along the length of the duct and between each of the ribs.

It is an object of the present invention to provide a deviator system that is light, corrosion-resistant and has superior bonding properties with concrete.

It is another object of the present invention to provide a deviator system that prevents concrete spalling and deterioration due to expansion of corroding elements.

It is another object of the present invention to provide a deviator system that can be easily placed into concrete segments.

It is another object of the present invention to provide a deviator system which reduces material costs.

It is a further object of the present invention to provide a deviator system which is easy to transport, easy to handle, and easy to install.

It is an other object of the present invention to provide a deviator system which facilitates the ability to establish 50% internal post-tensioning and 50% external post-tension in such segmental construction.

These and other objects and advantages of the present invention will become apparent from a reading of the attached specification and appended claims.

BRIEF SUMMARY OF THE INVENTION

The present invention is an apparatus comprising a first concrete segment having an interior passageway, a duct affixed within the interior passageway, a pipe extending through the duct, and a plurality of tendons extending through the pipe. The duct has a diameter at one end thereof that is substantially greater than the diameter the duct away from this end. The pipe has a diameter less than a diameter of the duct.

The duct can also have a diameter at an opposite end thereof that is substantially greater than the diameter away from the one end. The duct has a generally constant diameter along a length of the duct between the ends thereof. The duct has a portion constantly increasing in diameter toward the one end. In one embodiment of the present invention, the duct can have an arcuate shape between the ends thereof.

The first concrete segment has a first side and a second side. One end of the duct is flush with the first side. An opposite end of the duct is flush with the second side. The duct can be formed of a polymeric material. The pipe is of a high density polyethylene material. The duct has a plurality of ribs formed on an outer surface thereof. This plurality of ribs is embedded in the first concrete segment.

A second concrete segment can be positioned adjacent to the first concrete segment. The second concrete segment has an interior passageway. The pipe and the plurality of tendons extend through the interior passageway and the second concrete segment. The duct does not extend into the second concrete segment.

The present invention is also an apparatus for use in concrete segmental construction. This apparatus comprises a duct having a first end, a second end and a central portion formed between the first and the second ends, and a pipe extending through an interior of the duct. The first end has a diameter substantially greater than a diameter of the central portion. The pipe has a diameter substantially less than the diameter of the duct at the first end. The pipe has a length substantially greater than a length of the duct.

A plurality of tendons can extend through the pipe. The second end of the duct has a diameter substantially greater than the diameter of the central portion of the duct. The duct increases constantly in diameter from the central portion to the first end. The duct has a plurality of ribs formed on an exterior surface thereof. The duct is formed of a polymeric material. The pipe is formed of a high-density polyethylene material.

The present invention is also an article for use in segmental construction. This article includes a duct having a first end portion, a second end portion and a central portion formed between the first end portion and the second end portion. The first end portion has a diameter greater than a diameter of the central portion. The duct is formed of a polymeric material. The second end portion of the duct has a diameter greater than a diameter of the central portion. The first end portion constantly increases in diameter from the central portion to an end of the duct. The second end portion also constantly increases in diameter from the central portion to an opposite end of the duct. The duct has a plurality of ribs formed on an exterior surface thereof.

The foregoing Summary of the Invention section is intended to describe generally the elements of the preferred embodiments of the present invention. It is understood that variations to these preferred embodiments can be made within the scope of the present invention. This section is not intended, in any way, to be limiting of the scope of the present invention. The present invention should only be limited by the following claims and their legal equivalents.

DETAILED DESCRIPTION OF THE INVENTION

Figure 1:
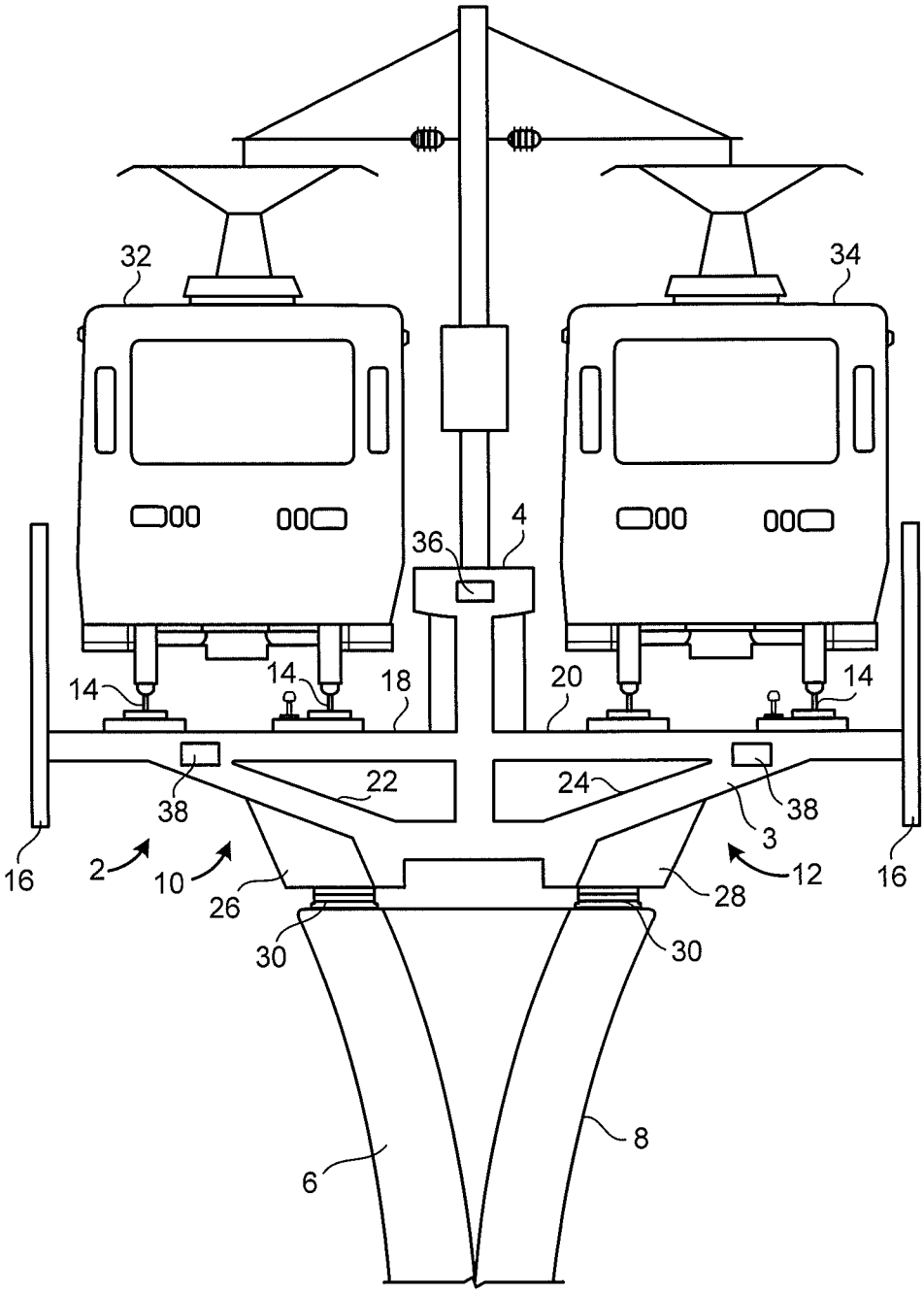
FIG. 1 Prior Art
FIG. 1 shows an end elevational view of a prior art concrete section of a rapid transit viaduct system, with the concrete section being a concrete segment of a segmental concrete structure.
Figure 2:
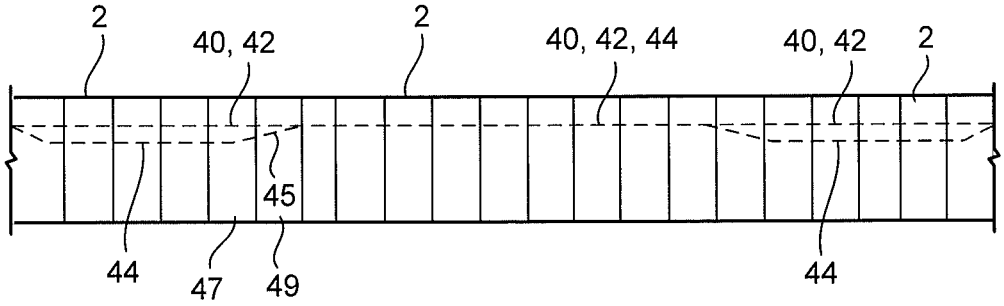
FIG. 2 Prior Art
FIG. 2 shows a plan view of a viaduct system formed from precast sections.
Figure 3:
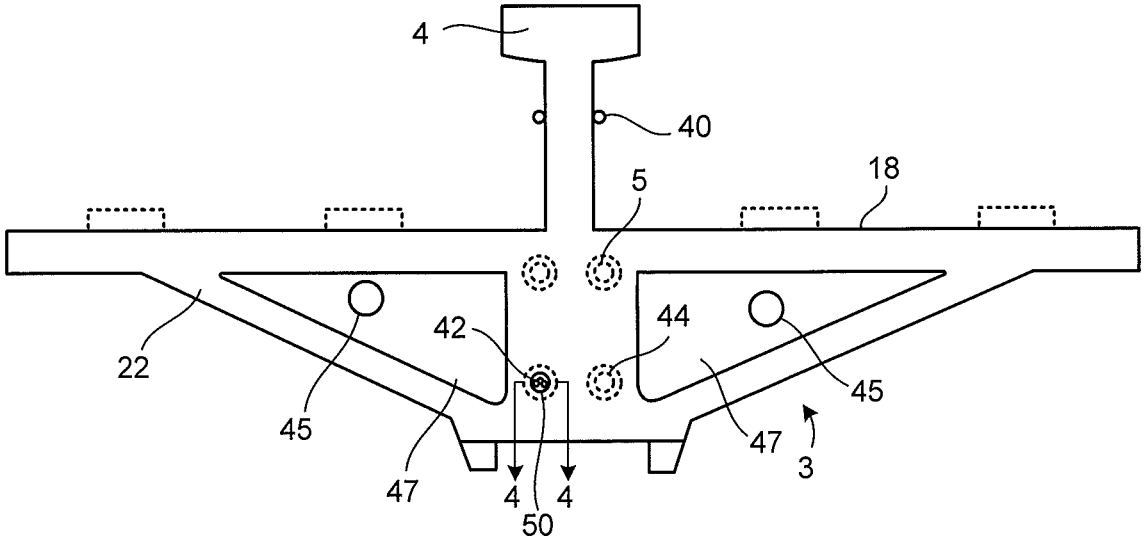
FIG. 3 Prior Art
FIG. 3 is an end view of a precast concrete segment used in segmental construction of a rapid transit system.
Figure 4:
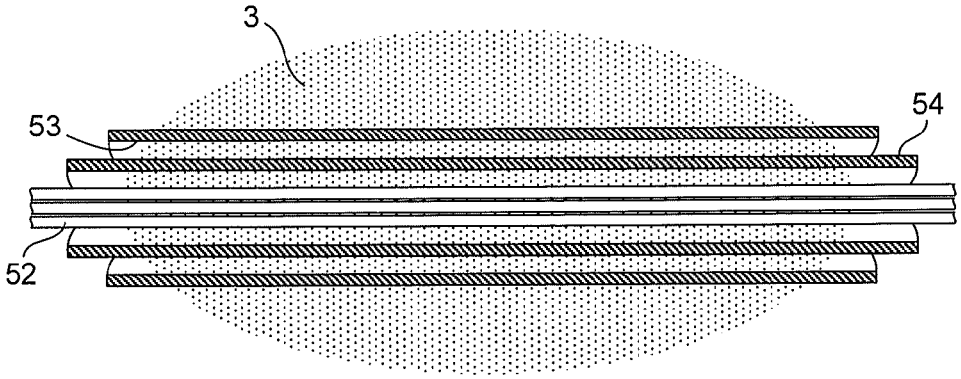
FIG. 4 Prior Art
FIG. 4 shows a cross-sectional view of a tunnel formed in the concrete segment, taken along sight line 4-4 of FIG. 3.
Figure 5:
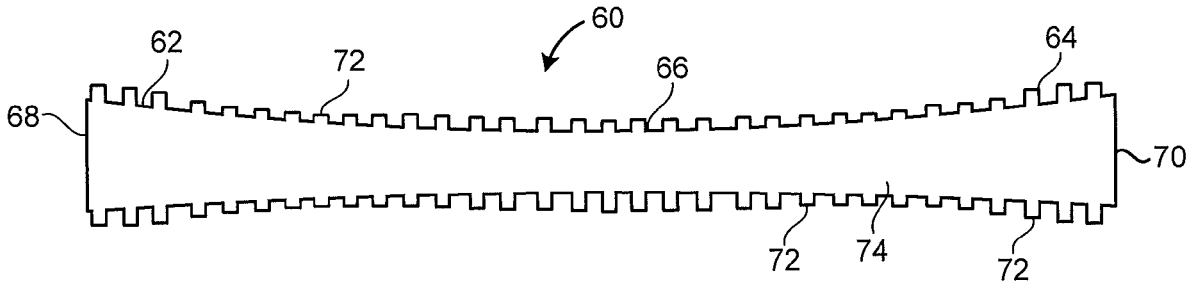
FIG. 5 is a cross-sectional view showing the duct as used in the deviator system of the present invention.

Referring to FIG. 5, there is shown the duct 60 as used in the deviator system of the present invention. The duct 60 has a first end portion 62, a second end portion 64 and a central portion 66. The central portion 66 is located between the first end portion 62 and the second end portion 64. It can be seen that the first end portion 62 has a diameter greater than a diameter of the central portion 66. Similarly, the second end portion 64 has a diameter greater than the diameter of the central portion 66. The duct 60 is formed of a polymeric material.

The first end portion 62 has a constantly increasing diameter extending from the central portion 66 to the first end 68. The second end portion 64 has a constantly increasing diameter extending from the central portion 66 to the second end 70. A plurality of ribs 72 are formed on the exterior of the duct 60. Ribs 72 are in the nature of corrugations that can be formed around the circumference of the duct 60. These corrugations 72 are integrally formed with the duct 60. When installed in concrete, these ribs 72 provide superior bonding with the concrete on the exterior of the duct 60 and provides superior bonding within a grout, or other components, that are applied into the interior passageway 74 of the duct 60.

Figure 6:
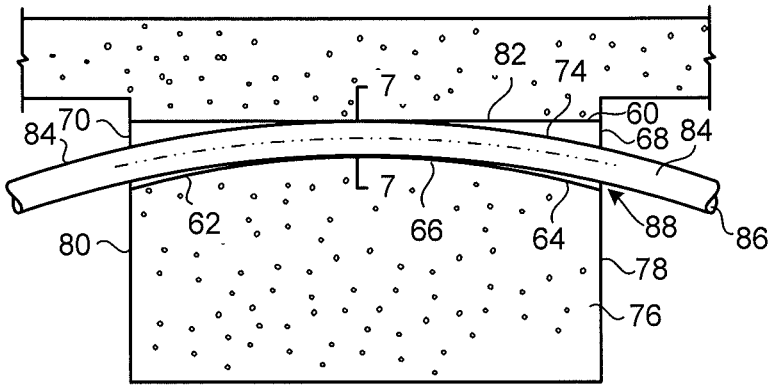
FIG. 6 shows the deviator system of the present invention as utilized in association with a concrete segment.

FIG. 6 shows the duct 60 as installed within a first concrete segment 76. The duct 60 has the first end 68 and the second end 70 generally flush with a first side 78 and a second side 80 of the concrete segment 76. The duct 60 is formed so as to define an interior passageway 82 of the concrete segment 76. Conventionally, the duct 60 is molded within the concrete segment 76. As such, the ribs 72 of the duct 60 will strongly bond with the concrete once the concrete has solidified.

In FIG. 6, the duct 60 has its first end portion 62 generally widening toward the first side 78 of the concrete segment 76. Similarly, the duct 60 has the second end portion 64 widening as it approaches the second side 80 of the concrete segment 76. The diameter of the duct 60 at the end 68 is substantially greater than the diameter of the duct 60 at the central portion 66. Similarly, the diameter of the duct 60 at the second end 70 is substantially greater than the diameter of the duct 60 at the central portion 66.

A pipe 84 extends through the interior passageway 74 of the duct 60. Pipe 84 is formed of a high-density polyethylene material. The pipe 84 also has an interior passageway 86 through which tendons can extend. The pipe 84 has a length substantially greater than the length of the duct 60. As such, the pipe 84 is utilized for the routing of the post-tension tendons through the segmental construction.

As can be seen in FIG. 6, the expanded diameters of the first end portion 62 and the second end portion 64 allow the pipe 84 to assume a proper arcuate configuration through the concrete segment 76. Because of the widened end 68 of the duct 60, the pipe 84 will not contact or will only slightly contact the surfaces of the duct 60 at the first side 78 of the concrete segment 76. As can be seen in FIG. 6, when the tendons within the pipe 84 are tensioned, a small space 88 will occur between the interior surfaces of the duct 60 and the exterior surfaces of the pipe 84. As such, the present invention avoids unnecessary compressing, strioping or fracturing of the duct 60 at the first side 78. A similar arrangement occurs with respect to second end 70 of the duct 60 in relation to the pipe 84.

The exterior surfaces of the pipe 84 will contact the duct 60 in the central portion 66. However, this is a wide area distributed contact. As such, the point-of-contact forces that can be damaging to the duct 60 are avoided in this central portion 66. The gradual widening of the end portions 62 and 64 allows extreme forces to be applied to the tendons within the interior passageway 86 to be applied without any destructive contact with the surfaces of the duct 60.

Since the duct 60 is of a polymeric construction, it is lightweight and corrosion resistant. Since no metallic material is used within the concrete segment 76, the present invention prevents concrete spalling and deterioration due to the expansion of any corroding elements. The use of the polymeric material decreases material costs. The polymeric duct 60 is easy to transport, easy to handle and easy to install.

Figure 7:
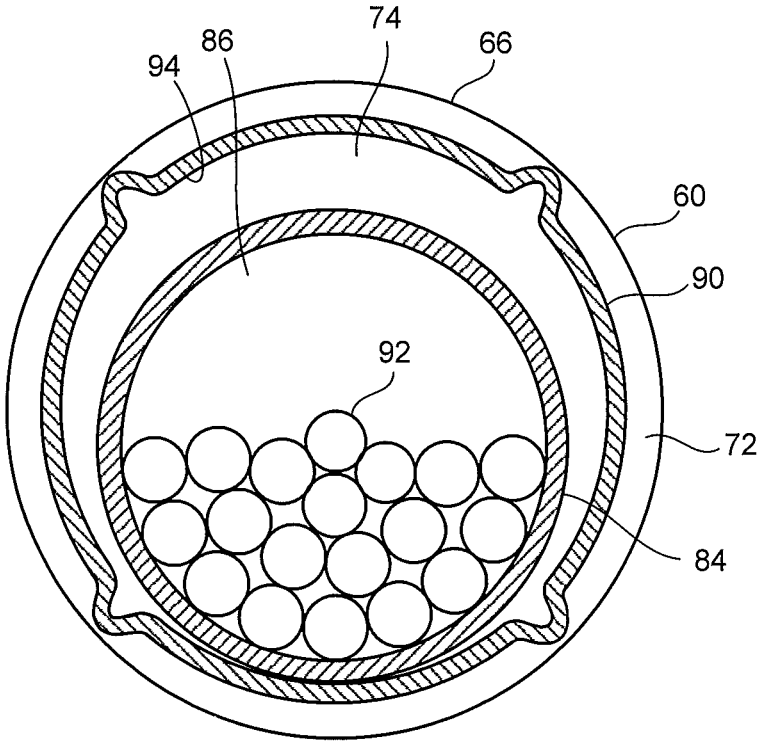
FIG. 7 is a cross-sectional view of the deviator system of the present invention as taken across lines 7-7 of FIG. 6.

FIG. 7 is a cross-sectional view of the duct 60 as taken at the central portion 66. As can be seen, the duct 60 has ribs 72 extending entirely around the outer diameter thereof. Ribs 72 extend outwardly of an exterior surface 90 of the duct 60. The duct 60 is of a circular-cross section. The exterior surface 90 defines the interior passageway 74 of the duct 60.

The pipe 84 is positioned within the interior passageway 74 of the duct 60. The pipe 84 also has circular-cross section. The interior passageway 86 of the duct 60 serves to receive a plurality of tendons 92 therein.

As can be seen in FIG. 7, when the tendons 92 are tensioned, they will bear against an interior wall of the pipe 84. The exterior wall of the pipe 84 will bear against the inner wall 94 of the duct 60 in the central portion 66. As such, there is a wide area distributed contact between the pipe 84 and the duct 60.

Figure 8:
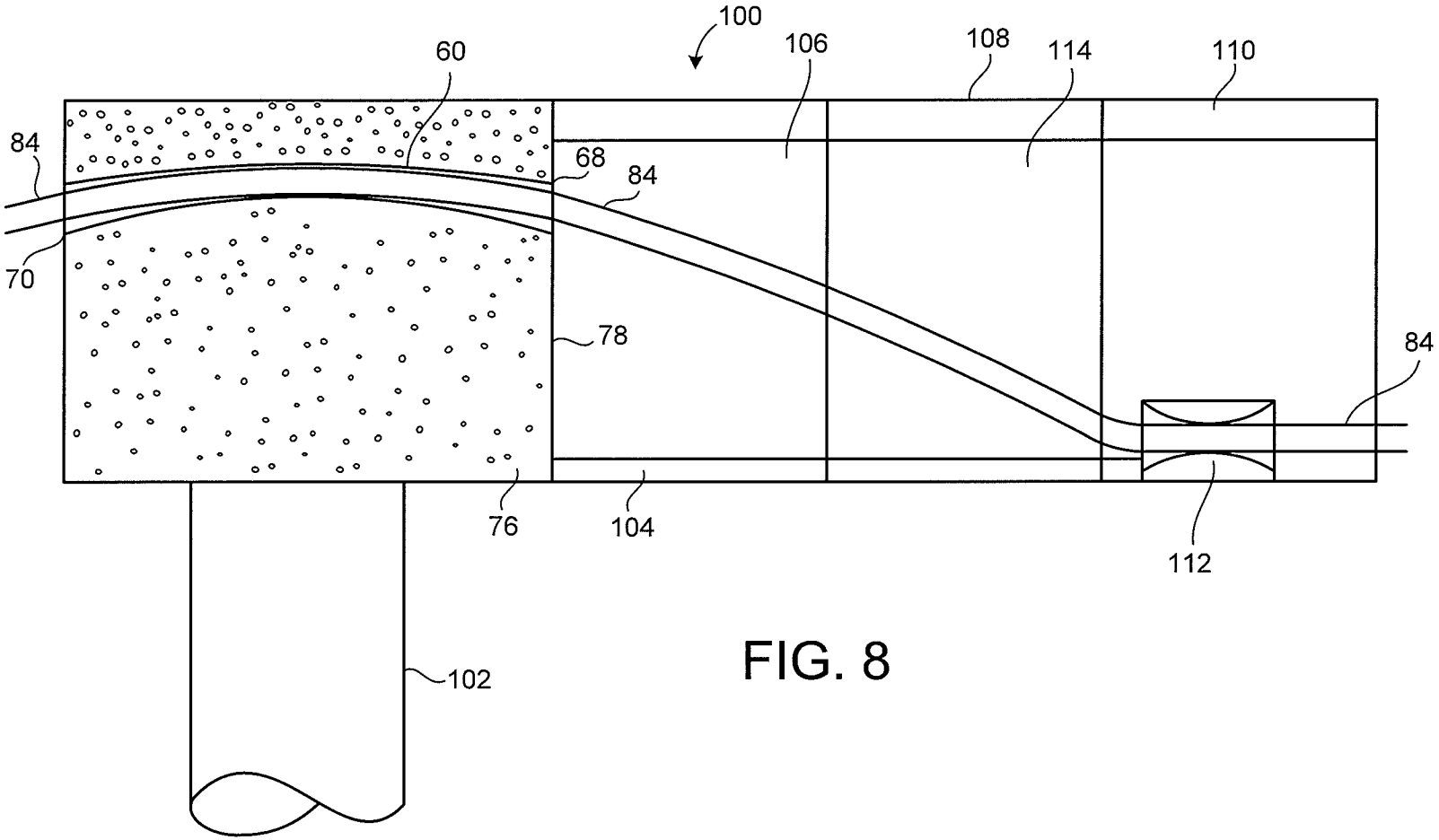
FIG. 8 is a cross-sectional view showing the routing of the pipe through the multiple segments of the segmental structure.

FIG. 8 shows the installation of the deviator system of the present invention within multiple segments of a post-tension concrete structure 100. In particular, it can be seen that concrete segment 76 is located at the top of a pier 102. The duct 60 is installed within the solid concrete segment 76 so as to have a generally arcuate shape. The pipe 84 extends through the interior passageway of the duct 60. The pipe 84 also extends outwardly beyond the second end 70 of the duct 60.

A second concrete segment 104 is placed against the side 78 of the first concrete segment 76. Concrete segment 104 defines an interior box opening 106 therein. The pipe 84 (along with the tendons therein) will extend through the box opening 106 of the second concrete segment 104. The pipe 84 also extends through a third concrete segment 108 and into a fourth concrete segment 110. A deviator diaphragm 112 is located within the fourth concrete segment 110 so that the pipe 84 (along with its associated tendons) can be routed therethrough. As such, the pipe 84 (and the interior tendons) will take on a proper curvature throughout the concrete structure 110. This serves to meet the design requirements of the structure 110.

Typically, the duct 60 will be embedded within the concrete of the first concrete segment 76. The concrete segment 76 is then installed upon the pier 102. The pipe 84 is then routed through the duct 60, through the box opening 106 of the second concrete segment 104, the box opening 114 of the third concrete segment 108 and the deviator diaphragm 112 of the fourth concrete segment 110. The tendons can then be pushed through the interior of the pipe 84. After the tendons are properly installed, they can be tensioned in a conventional manner.

As can be seen in FIG. 8, the configuration of the duct 60 avoids any point-of-contact pressures against the ends 68 and 70 of the duct 60. These widened ends 68 and 70 allow the pipe 84 to pass outwardly therefrom without any significant contact occurring. As such, the forces of the tensioned cables will bear entirely over a broad and wide interior surface of the duct 60. Damage to the duct and potential fracturing of the duct is effectively avoided.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a first concrete segment having an interior passageway, said interior passageway generally increasing in diameter from a center thereof toward one end of said interior passageway;

a duct embedded in said first concrete segment and affixed within said interior passageway of said first concrete segment, said duct having a diameter at one end thereof that is substantially greater than a diameter of said duct away from said one end of said duct, said duct constantly increasing in diameter toward said one end of said duct;

a pipe extending through said duct, said pipe having a diameter less than a diameter of said duct away from said one end of said duct; and a plurality of tendons extending through said pipe.

2. The apparatus of claim 1, said duct having a diameter at an opposite end thereof that is substantially greater than the diameter of said duct away from said one end of said duct.

3. The apparatus of claim 1, said duct having an arcuate shape between said one end and an opposite end thereof.

4. The apparatus of claim 1, said first concrete segment having a first side and a second side, said one end of said duct being flush with said first side, an opposite end of said duct being flush with said second side.

5. The apparatus of claim 1, said duct being of a polymeric material, said pipe being of a high-density polyethylene material.

6. The apparatus of claim 1, said duct having a plurality of ribs formed on an outer surface thereon, said plurality of ribs being embedded in said first concrete segment.

7. The apparatus of claim 1, further comprising:

a second concrete segment positioned adjacent to said first concrete segment, said second concrete segment having an interior passageway, said pipe and said plurality of tendons extending through said interior passageway and said second concrete segment.

* * * * *